United States Patent [19]

Michelotti

[11] Patent Number: 4,667,881

[45] Date of Patent: May 26, 1987

[54] FLASK FOR CYCLISTS

[75] Inventor: Guido Michelotti, Vicenza, Italy

[73] Assignee: Campagnolo S.p.A., Vicenza, Italy

[21] Appl. No.: 725,487

[22] Filed: Apr. 22, 1985

[30] Foreign Application Priority Data

Apr. 20, 1984 [IT] Italy ..... 20651 A/84

[51] Int. Cl.[4] ..... B65D 47/20

[52] U.S. Cl. ..... 239/375; 222/525; 239/458

[58] Field of Search ..... 239/456, 438–441, 239/327, 460, 375, 458; 222/212, 215, 525

[56] References Cited

U.S. PATENT DOCUMENTS

| | | | |
|---|---|---|---|
| 1,758,119 | 5/1930 | Le Moon | 239/460 |
| 2,554,409 | 5/1951 | Holder | 239/460 |
| 3,504,893 | 4/1970 | Susuki et al. | 239/327 |
| 4,057,177 | 11/1977 | Laauwe | 222/215 |
| 4,401,270 | 9/1983 | McKinney | 222/212 |

FOREIGN PATENT DOCUMENTS

| | | | |
|---|---|---|---|
| 2496598 | 12/1980 | France | 222/215 |
| 398708 | 10/1933 | United Kingdom | 239/456 |

*Primary Examiner*—Andres Kashnikow

*Attorney, Agent, or Firm*—Young & Thompson

[57] ABSTRACT

A flask for cyclists is equipped with a closing and delivery device for the liquid contained therein, which consists of a fixed part, comprising a bush having a partially open bottom and an orifice, and a central cylindrical body coaxial to the bush, connected to its bottom and projecting from its orifice, and of a mobile tubular nozzle part, cooperating with the bush and with the central body in order to close the flask, to deliver selectively a series of light sprays or to deliver a large single spout. The flask has an elongated shape, tapering towards the device, a gripping recess which is also elongated, and a flattened section on one side, all of which guarantee the ergonomic grip and, at the same time, the aerodynamic shape of the flask itself.

4 Claims, 7 Drawing Figures

FIG. 2
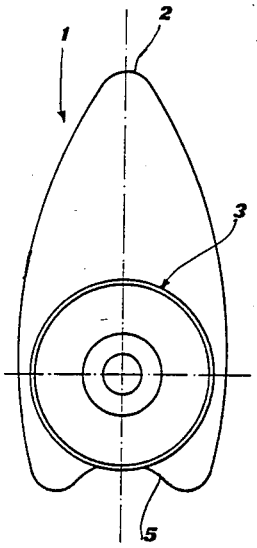
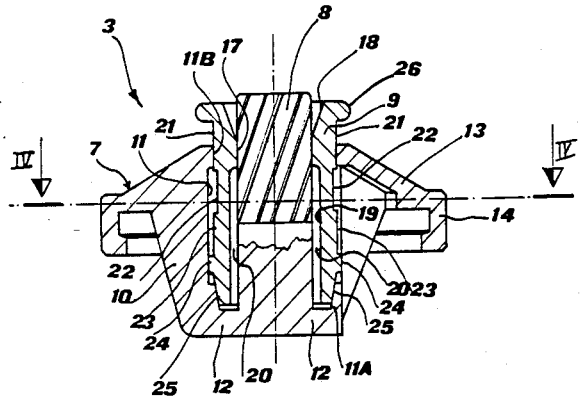
FIG. 3
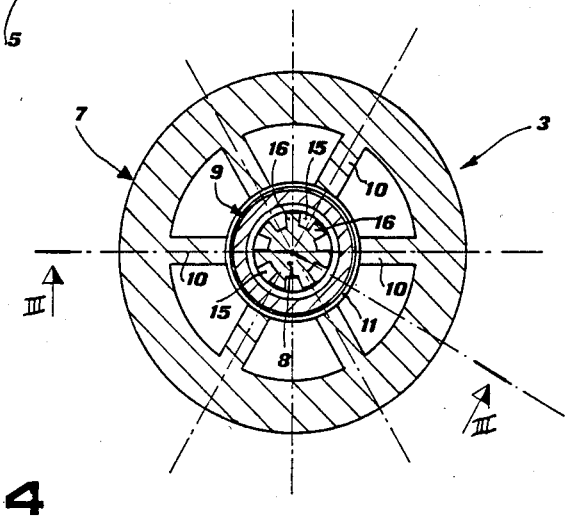
FIG. 4

FLASK FOR CYCLISTS

BACKGROUND OF THE INVENTION

The present invention relates to improvements in the flasks for cyclists, and more particularly flasks which are applied to the frame of racing bicycles during sports competitions, to allow racing athletes to dispose at once and, whenever required, both of a drink to quench their thirst and of some liquid to refresh themselves.

It is known that in order to perform its functions in the best possible way, the flask should be made so that:

it can be easily and comfortably seized by the cyclist, without forcing him to look and turn away his eyes from the road;

it can be used by the cyclist both to refresh his face and neck by sprinkling, while allowing him to hold his position bent on the handle bar, and to quench his thirst, without having to move from the handle bar and just by a slight turn of the head, so that he can keep a safe control of the running conditions;

it has an "aerodynamic" shape providing minimum air resistance and a very low friction surface, so that the total resistance to running, of the bicycle, is not apt to significantly increase due to the presence of the flask.

In other words, a flask for cyclists should guarantee at the same time an ergonomic grip, functional delivery and closing conditions, and limited air resistance.

None of the presently known flasks for cycles is adapted to guarantee all together and to an adequate extent the above characteristics. Though the usual cylindrical shape of traditional flasks has been abandoned for more elaborate designs, the object of these latter has been essentially to improve the aerodynamic aspect rather than the ergonomic one, while from the point of view of functionality of the delivery, according to the different requirements of the cyclist, the solutions adopted so far are either insufficient and inadequate or else they have defects and failures.

SUMMARY OF THE INVENTION

The flask for cycles according to the present invention—having an ergonomic and aerodynamic shape and comprising an adjustable closing device for two types of deliveries of the liquid contained therein—is instead apt to solve in an adequate and complete way all the problems connected with this very special article, and thus the problems of a great number of cycling professionals and fans.

This flask is mainly characterized by the fact that it comprises a closing and delivery device for the liquid contained therein, which consists of a fixed part, comprising a bush having a partially open bottom and an orifice, and a central cylindrical body coaxial to the bush, connected to its bottom and projecting from its orifice, and of a mobile tubular nozzle part, cooperating with said bush and with said central body in order to close the flask, to deliver a series of light sprays and to deliver a large single spout.

According to the invention, the flask equipped with the aforespecified closing and delivery device has furthermore an elongated shape, tapering towards the device, a gripping recess which is also elongated, and a flattened section on one side, all of which guarantee the ergonomic grip and, at the same time, the aerodynamic shape of the flash itself.

BRIEF DESCRIPTION OF THE DRAWINGS

The invention will now be described in further detail with reference to the accompanying drawings, which represent, by mere way of example, a presently preferred embodiment of the flask according to the invention, and in which:

FIG. 2 is a top view of the flask of FIG. 1;

FIG. 3 is an axial section view, along the line III—III of FIG. 4, partially interrupted and on an enlarged scale, of the closing and delivery device of the flask of FIG. 1, according to the invention;

FIG. 4 is a cross section view, along the line IV—IV of FIG. 3; and

DESCRIPTION OF THE PREFERRED EMBODIMENT

Figure 1:
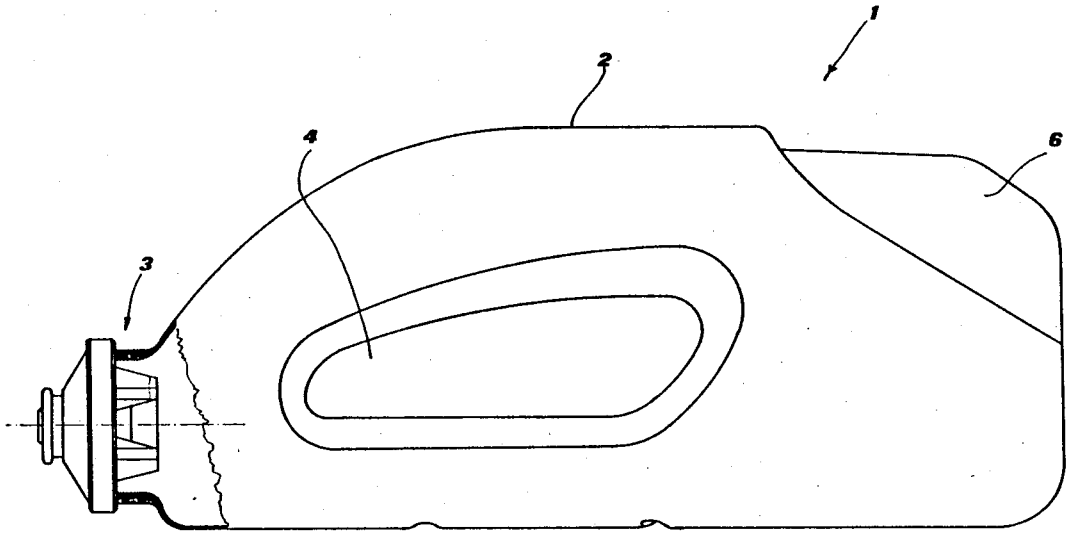
FIG. 1 is a lateral comprehensive view of the flask according to the invention.

With reference to the accompanying drawings, the flask according to the invention comprises a container 1, of synthetic plastic material, having an elongated shape tapering on the side 2 towards the closing and delivery device 3, a gripping recess 4, also of elongated shape, being formed in said container 1. The container 1 has a flattened section on the side 2 and is provided, on the opposide side, with a concavity 5 adapted to mate with the tube of the bicycle frame, to which the flask is applied. The recess 4 has an irregular quadrilateral shape with rounded corners. On the side opposite to the closing and delivery device 3, the container 1 has a depressed corner 6, with which is meant to cooperate an element for fixing the flask to the bicycle frame.

The delivery device 3, also of synthetic plastic material, comprises a fixed part 7—firmly connected to the container 1—from which projects a central cylindrical body 8, and a mobile part 9, associated and cooperating with said body 8 and forming the nozzle.

The fixed part 7 of the device 3 comprises an outer body with radial fins 10, which support a cylindrical bush 11 having a frustoconical bottom 11A and a narrow top 11B, and which support—through their extensions 12—the central cylindrical body 8 coaxial and internal to said bush 11, as well as a wide upper flange 13 with bent edge 14, for connection to the mouth of the container 1.

The central cylindrical body 8 of the fixed part 7 is crossed (FIG. 4) on its outer surface by seven cylindrical helical grooves 15, separated by an equal number of teeth 16, said helical grooves being inclined by about 20°.

The mobile part 9 of the closing and delivery device 3 comprises a substantially cylindrical tubular element, whose inner surface adheres for a short length 17, close to the cone-shaped outlet end 18, to the central cylindrical body 8 of the fixed part 7; while, for the remaining length 19 of said element, the inner surface thereof keeps well apart from said body 8, creating a cylindrical cavity 20. The outer surface of said element 9 comprises in turn—starting from the outlet end towards the inner part—three zones of slightly different diameter, 21, 22 and 23 respectively, terminating with a projecting flange 24 and a frustoconical end 25. This conical end 25 and the flange 24 of said element 9 mate, respectively, with the conical bottom 11A and with the inner wall of the bush 11, while the three zones 21, 22 and 23 are adapted to cooperate with the top 11B. In order to form a nozzle acting as mouthpiece, the mobile part 9 of the device comprises an external flange 26.

Figure 5:
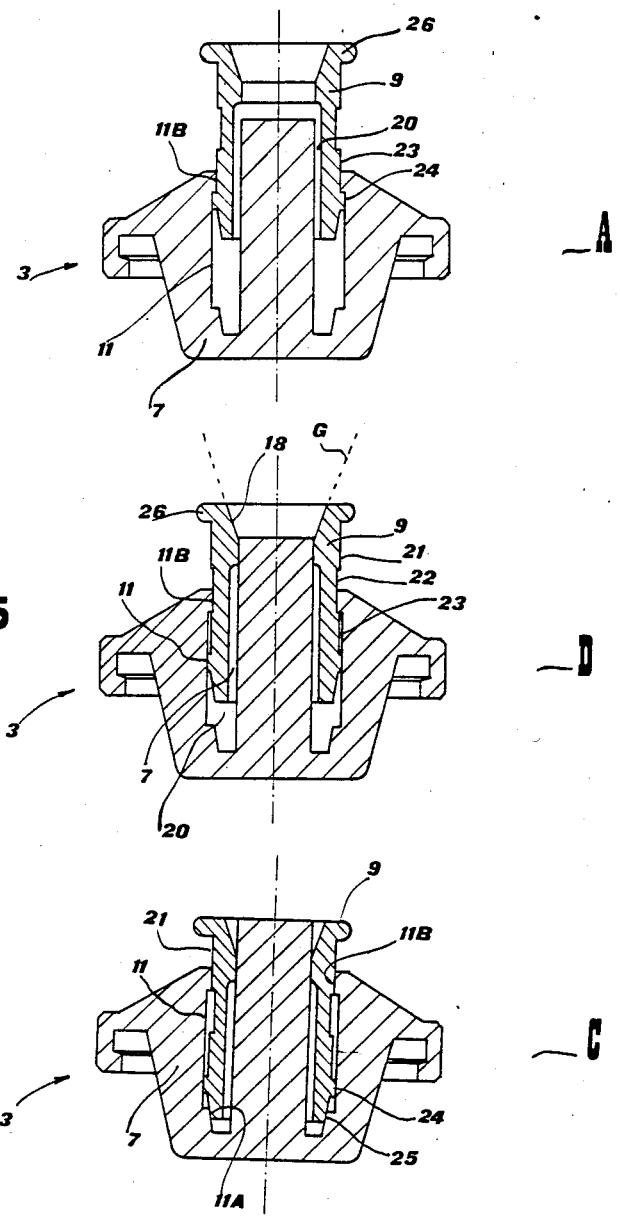
FIG. 5 shows diagrammatically, on a reduced scale, the three different working positions of the device of FIGS. 3 and 4, in the closing condition C and in the two delivery conditions D and A.

When using the flask, the closing and delivery device 3 works as shown in FIG. 5, which illustrates the fundamental positions thereof.

The device closes the flask in position C, which is also that shown in FIG. 3. In this position, the mobile part 9 is thoroughly pressed into the fixed part 7 of the device 3 and is firmly held therein thanks to the engagement of its zone 21 with the top 11B of the bush 11 of part 7, said zone 21 having a slightly wider diameter than that of said top 11B. Thus, the liquid of the flask, which freely floods the partially open bottom of the bush 11, remains shut therein thanks to the flange 24 and to the frustoconical end 25 of the mobile element 9—which respectively adhere to the cylindrical wall of the bush 11 and to its bottom 11A—and cannot come out of the flask .

When the cyclist wishes to take a refreshening shower, he partially draws out the mobile part 9 by gripping with his teeth the flange 26. Said mobile part 9 then slides through the top 11B of the bush 11, with zones 21 and 22 in registry with each other, zone 22 having smaller diameter than the zones 21 and 23—until it is stopped by said zone 23 when reaching the top 11B (position D of FIG. 5). The liquid flowing from the flask into the bush 11 is thus let into the cavity 20 and, from this, into the helical grooves 15 of the body 8, so that seven spouts G are let out—in a distinct and evenly distributed arrangement, tangentially to the outlet end of the mobile part 9—of the device 3. The cyclist can thereby take a perfectly uniform and efficient shower, without wasting any liquid.

When the cyclist wishes instead to drink, he has to continue drawing out the mobile part 9 of the device 3 beyond the previous position. To do this, he again uses his teeth, but pulling part 2 farther. The zone 23 of the nozzle part 9, having a slightly wider diameter than the top 11B, will thus also slide through this latter, thanks to the mutual elastic deformation of the cooperating parts, deriving from the type of materials used and from the slight interference of their diameters (as had already occurred in the previous opening operation, though with less deformation and efforts).

The nozzle part 9 finally stops when the flange 24 engages the top 11B of the bush 11, i.e. when it has reached position A of FIG. 5. In this position, the liquid of the flask which floods the bush 11 is free to flow towards the large orifice with conical end 18 of the nozzle part 9, through the cavity 20 which, in this case, also extends beyond the central body 8 of the fixed part 7 of the device. The cyclist will thus receive a single large spout of liquid to quench his thirst.

It is understood that, by pressing the nozzle part 9 towards the flask, it will be at once possible to switch from the single spout delivery position A (for drinking) to the shower delivery position D (for refreshment), and from this to the closing position C of FIG. 5.

It can easily be seen that the flask according to the invention is a great improvement in the specific field of application for which it has been designed.

In fact:

Its aerodynamic shape combines with an ergonomic configuration, characterized by a handgrip which highly facilitates seizing and holding the flask; in fact, the thumb can join in opposition the other four fingers introduced in the proper recess 4. Also the shape and inclination of said recess are such as to facilitate gripping the flask; a slight downward bending of the arm, without turning the wrist, is sufficient to place the hand in the exact gripping position.

The closing and delivery device, as seen, can easily be operated by the cyclist to take up three distinct positions, namely: closed, shower and fully open position.

The delivery of the shower is obtained with the first opening click of the nozzle, by seizing it with one's teeth and holding the flask with one hand. As opposed to some types of flasks on the market—wherein the shower spout comes out in a disorderly way, with consequent scarce effectiveness and waste of water—the distribution of the liquid from the device of the flask according to the invention is characterized by the perfectly conical shape of the spout, such as to cover with a light and evenly distributed spray the whole area of the head to be refreshened, and only that area, when the flask is held at the normal and most comfortable distance for the cyclist. This provides a more effective refrigerating action, with less water consumption, and it is obtained thanks to the grooves 15 which are helically arranged around the central body 8 of part 7 of the device.

The second click allows one to obtain—also in this case with the help of teeth—the full opening of the delivery nozzle.

Also as concerns this position, the facilitated gripping and holding of the flask with one hand allows one, with a minimum effort, to easily dose the liquid contained therein; the rate of flow can in fact be manually controlled by associating the action of gravity with that of the pressure determined by a tight grip on the plastic container 1. The racing cyclist or fan may thus use the flask in the most comfortable and practical manner, without being any longer forced to dangerously turn his head backward or sideways.

The flask, made with a section shaped as a drop, a smooth surface and rounded corners, eliminates resistances, frictions and eddies, so that, when mounted on the bicycle, the total aerodynamic resistance of the vehicle is not apt to appreciably increase.

It is to be understood that the flask according to the invention may also be made differently from the embodiment thereof heretofore described and illustrated, which may easily include variants and modifications, without thereby departing from the scope of the invention itself.

I claim:

1. Flask for cyclists, comprising a closing and delivery device for the liquid contained therein, which consists of a fixed part, comprising a bush having a partially open bottom and a top, a central cylindrical body coaxial to the bush, connected to said bottom and projecting from said top, and a mobile tubular nozzle part, cooperating with said bush and with said central body in order to close the flask, to deliver selectively a series of light sprays or to deliver a large single spout, said central body of the fixed part comprising a plurality of grooves and an inner surface of said tubular nozzle part adhering, for a short length close to an outlet end of the nozzle part, to said central body, while for all the remaining length, it is spaced from said body creating a cavity, an outer surface of said nozzle part cooperating with said bush and with the bottom and top thereof through zones of different diameter, through a flange and through a frustoconical end, so as to take up three different set positions for, respectively, closing the flask, delivering a light shower through the partially open bottom of the bush and through said cavity and grooves, and delivering a single spout through the partially open bottom of the bush and through said cavity, said nozzle part in said position closing the flask having its maximum penetration into the flask and in said position delivering a light shower being partially extended outside the flask from said maximum penetration and in said position delivering a single spout being maximally extended outside the flask and clearing said central body and establishing direct communication between said cavity and the ambient atmosphere.

2. Flask as in claim 1, wherein the mobile tubular nozzle part of the closing and delivery device ends with a conical end and said grooves are helical.

3. Flask as in claim 1, wherein both the fixed and the mobile part of the closing and delivery device are made of synthetic plastic material.

4. Flask as in claim 1, wherein the container has an elongated shape tapering towards the closing and delivery device, a gripping recess which is also elongated, and a flattened section on one side, all of which guarantee an ergonomic grip and, at the same time, an aerodynamic shape of said flask.

* * * * *